United States Patent [19]

Sakakibara

[11] 4,249,457

[45] Feb. 10, 1981

[54] VACUUM SERVOMOTOR

[75] Inventor: Naoji Sakakibara, Chiryu, Japan

[73] Assignee: Aisin Seiki Kabushiki Kaisha, Aichi, Japan

[21] Appl. No.: 962,993

[22] Filed: Nov. 22, 1978

[30] Foreign Application Priority Data

Dec. 14, 1977 [JP] Japan ..... 52-151004

[51] Int. Cl.[3] ..... F15B 11/08; F15B 13/044

[52] U.S. Cl. ..... 91/450; 91/459; 137/625.65

[58] Field of Search ..... 91/459, 275, 361, 6, 91/450; 137/625.65, 596.17; 92/161, 78

[56] References Cited

U.S. PATENT DOCUMENTS

| | | | |
|---|---|---|---|
| 1,908,471 | 5/1933 | Brewer | 91/459 |
| 2,340,817 | 2/1944 | Hurst | 91/459 |
| 3,477,346 | 11/1969 | Slavin et al. | 91/361 |
| 3,584,650 | 6/1971 | Macauley | 137/625.65 |
| 3,654,963 | 4/1972 | Ages | 137/625.65 |
| 3,763,744 | 10/1973 | Fournell et al. | 91/450 X |
| 3,961,608 | 6/1976 | Hertfelder | 137/625.65 X |
| 4,128,044 | 12/1978 | Larson et al. | 91/459 |

FOREIGN PATENT DOCUMENTS

| | | | |
|---|---|---|---|
| 407127 | 4/1967 | Australia | 137/625.65 |
| 2423516 | 11/1975 | Fed. Rep. of Germany | 91/459 |

*Primary Examiner*—Irwin C. Cohen

*Attorney, Agent, or Firm*—Oblon, Fisher, Spivak, McClelland & Maier

[57] ABSTRACT

A vacuum servomotor comprises a cup-shaped casing having a bottom wall provided thereon with a vacuum nozzle for connection to a source of vacuum and an air nozzle in communication with the atmosphere, the casing being integrally formed with a cylindrical support structure extending inwardly from the bottom wall and surrounding the air and vacuum nozzles. The servomotor further comprises a support plate secured to an inner end of the support structure, and an electromechanically operated solenoid valve assembly mounted on the support plate within the support structure to normally open and close the air and vacuum nozzles, the valve assembly closing and opening the air and vacuum nozzles in response to an output signal from an electric control circuit.

8 Claims, 11 Drawing Figures

VACUUM SERVOMOTOR

BACKGROUND OF THE INVENTION

The present invention relates to a vacuum servomotor activated in response to an electric output signal from an electric control system, such as an electric rotation speed control system for a vehicle engine, and more particularly to a vacuum servomotor in which a solenoid valve is provided within a servo chamber of the servomotor to modulate vacuum within the servo chamber in response to an electric control signal.

SUMMARY OF THE INVENTION

A primary object of the present invention is to provide an improved vacuum servomotor of which a casing is integrally formed with a cylindrical support structure to contain therein a solenoid valve assembly in a compact construction.

According to the present invention, there is provided a vacuum servomotor adapted, in use, to be activated by an output signal from an electric control circuit, comprising:

a cup-shaped casing having a bottom wall provided thereon with a vacuum nozzle for connection to a source of vacuum and an air nozzle in communication with the atmosphere, the casing being integrally formed with a cylindrical support structure extending inwardly from the bottom wall and surrounding the air and vacuum nozzles;

a spring-loaded diaphragm assembly heremetically coupled with an open end of the casing to form an expansible chamber within the casing;

a support plate secured to an open end of the cylindrical support structure; and a solenoid valve assembly mounted on the support plate and disposed within the support structure, the valve assembly including a core of magnetic material secured at one end thereof with the support plate and extending into the support structure, a solenoid winding surrounding the core to be energized by the output signal from the control circuit to provide a magnetic pole at the other end of the core, an armature of magnetic material arranged to be attracted on the magnetic pole by energization of the winding, and a pair of valve parts integral with the armature to normally open and close the air and vacuum nozzles respectively, the valve parts closing and opening the air and vacuum nozzles when the armature is attracted on the magnetic pole in response to energization of the winding.

BRIEF DESCRIPTION OF THE DRAWINGS

Additional objects and advantages of the present invention will be more readily apparent from the following detailed description of a preferred embodiment thereof when taken together with the accompanying drawings in which.

DESCRIPTION OF THE PREFERRED EMBODIMENT

Figure 1:
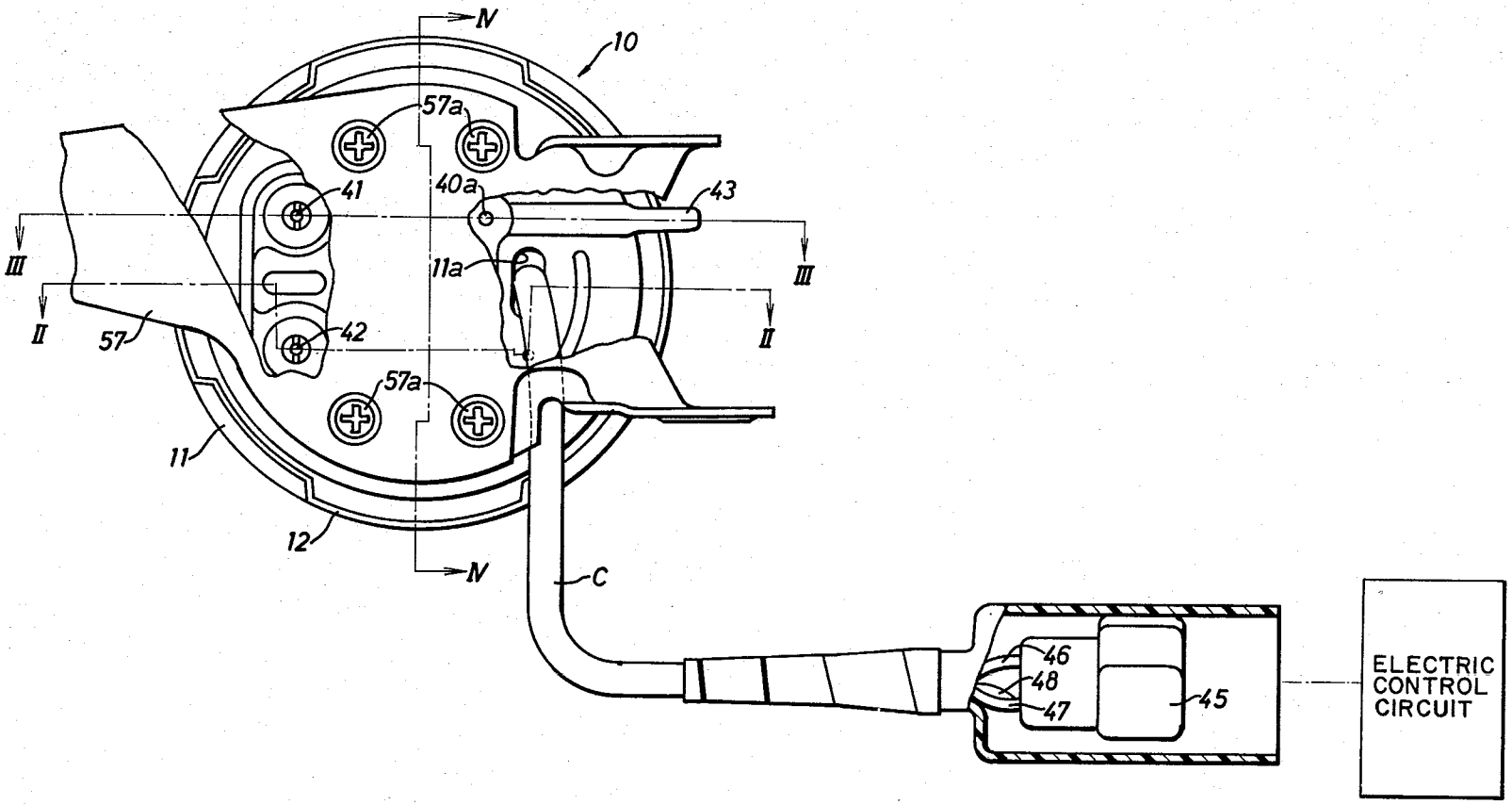
FIG. 1 is a fractionally broken side view of a servomotor in accordance with the present invention.
Figure 2:
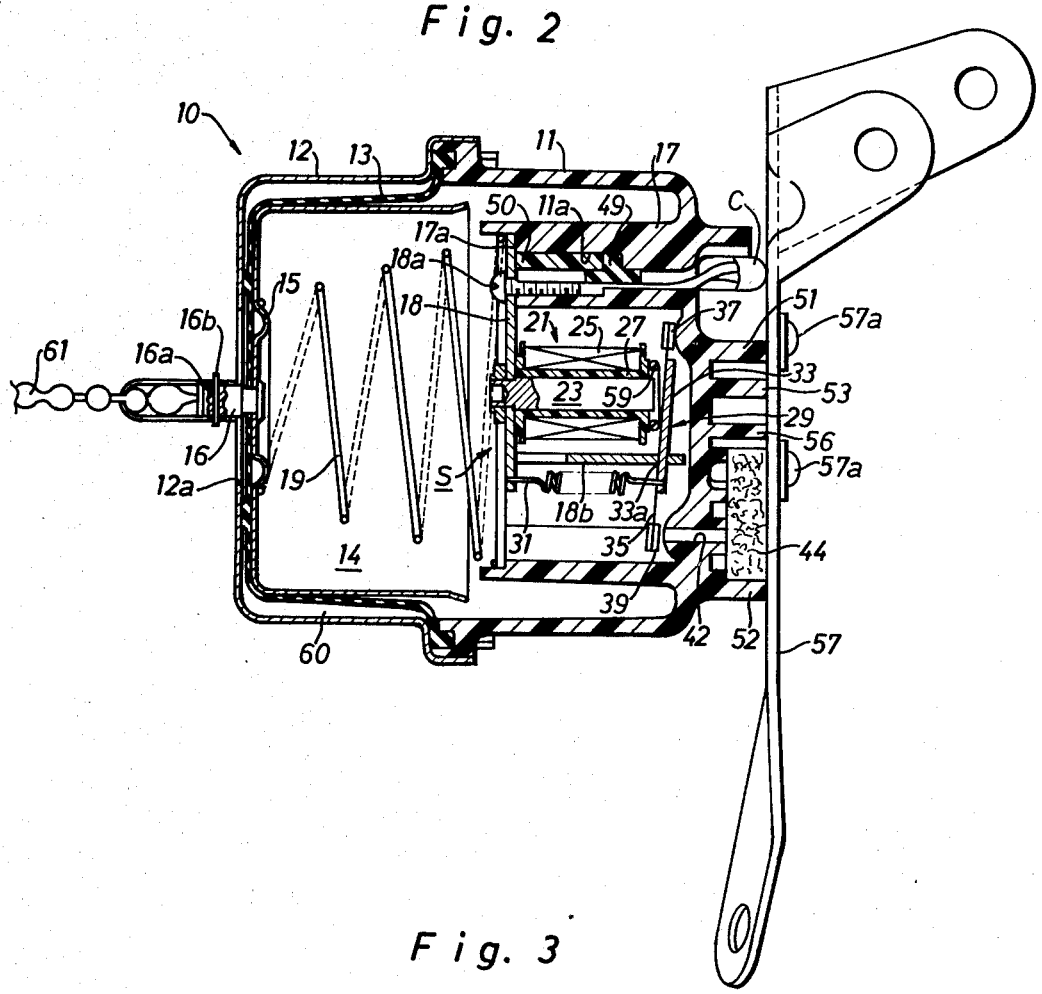
FIG. 2 is a sectional view taken along line II—II of FIG. 1.

Referring now to FIGS. 1 and 2 of the accompanying drawings, there is illustrated a preferred embodiment of a vacuum servomotor 10 in accordance with the present invention. The servomotor 10 comprises a casing assembly which has a cup-shaped casing 11 of synthetic resin and a cup-shaped casing 12 of sheet metal. The casing 11 is fastened by screws 57*a* to a bracket 57 to be fixed to an appropriate portion within an engine room of a vehicle. The casing 11 has an extension pipe 43 for connection to an intake manifold of the vehicle engine. The casing 11 is also provided therein with a cylindrical support structure 17 which extends inwardly from the bottom wall of casing 11 to accommodate therein an eletromechanically operated valve assembly S. The valve assembly S is electrically connected to a coaxial cable C which is led out through the bottom wall of casing 11 and terminates at a connector 45 for connection to an electric control circuit (not shown). In addition, the electric control circuit is provided to generate a series of first output signals for maintaining a desired speed of the vehicle in accordance with input signals from a speed sensor, the control circuit further generating a second output signal during the sequential generation of the first output signals.

The servomotor 10 further comprises a flexible diaphragm 13, of which an outer periphery is hermetically clamped between outer rims of casings 11, 12 to form a pressure chamber 14 and an air chamber 60, the air chamber 60 being communicated with the atmosphere through an opening 12*a* of casing 12. A cup-shaped rigid member 15 is fastened to the diaphragm 13 by a rivet 16 to retain the shape of diaphragm 13. A coil spring 19 is interposed between the rigid member 15 and the cylindrical support structure 17 to bias the diaphragm 13 toward the air chamber 60. The rivet 16 has a head 16*a* which projects outwardly through the opening 12*a* of casing 12 and is connected by a connecting pin 16*b* to a chain-linkage 61 to be operatively connected with a throttle valve for the vehicle engine.

Hereinafter, the construction of valve assembly S will be described in detail. As shown in FIGS. 2 to 5, the valve assembly S comprises a support plate 18 of magnetic material and a pair of solenoid valves 20, 21. The solenoid valves 20, 21 are accommodated within the support structure 17 and supported by the support plate 18 in parallel to each other (see FIGS. 4 and 5). The support plate 18 is fastened by screws 18*a* to mounting portions 17*a* which are formed on an open end of the support structure 17 (See FIGS. 2 and 5).

Figure 3:
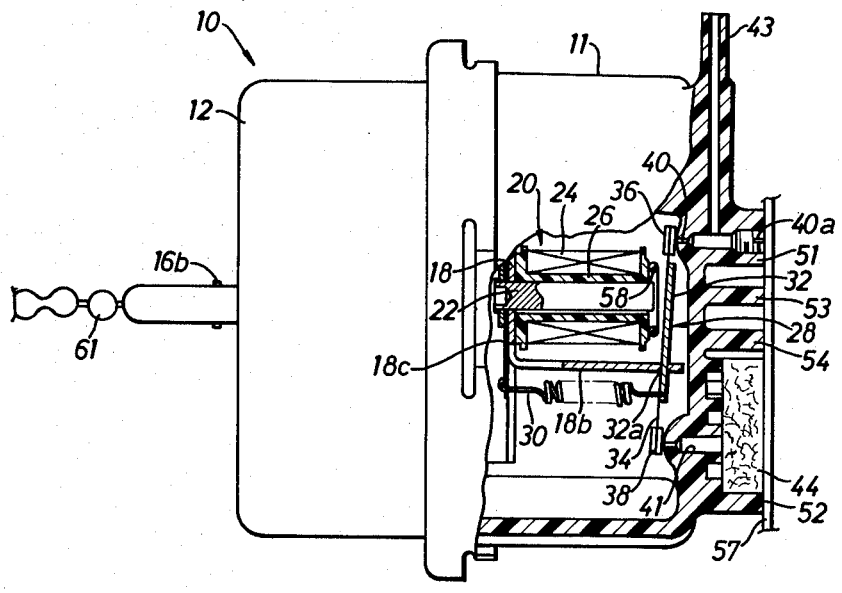
FIG. 3 is a partially sectional view taken along line III—III of FIG. 1.
Figure 4:
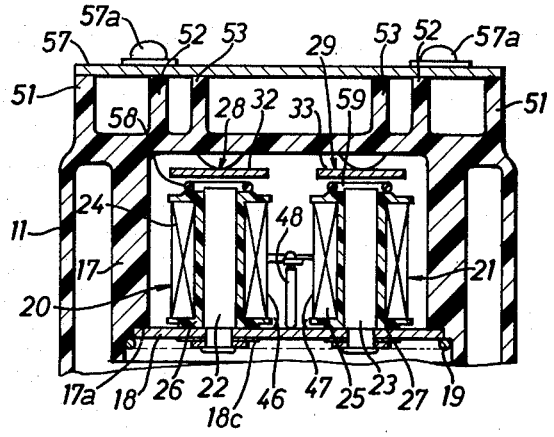
FIG. 4 is a partially sectional view taken along line IV—IV of FIG. 1.
Figure 5:
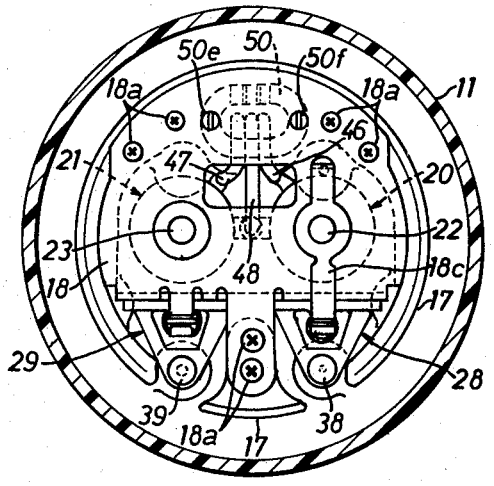
FIG. 5 is a side view illustrating an assembling construction of an electromechanically operated valve assembly against a cup-shaped casing.
Figure 6:
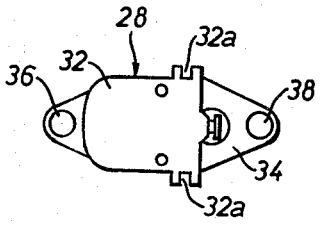
FIG. 6 is an enlarged view of a valve body of the electromechanically operated valve assembly.

The solenoid valve 20 comprises a core 22 of magnetic material surrounded by a solenoid winding 24 by way of a bobbin 26, as shown in FIGS. 3 to 5, the bobbin 26 being made of non-magnetic material. The core 22 is secured at its base end to the support plate 18 and provided at its top end or magnetic pole with an annular shock absorber 58. The solenoid valve 20 further comprises a first valve body assembly 28 having an armature 32 of magnetic material, a metal plate 34 of non-magnetic material and a pair of valve parts 36, 38. The armature 32 is fixed on a central portion of metal plate 34, as shown in FIGS. 3 and 6, and is swingably supported at its fulcrum 32*a* on a strut 18*b* extending from the support plate 18 such that the metal plate 34 faces directly to the magnetic pole of core 22. The armature 32 is also biased in a direction apart from the magnetic pole of core 22 by a coil spring 30 which is engaged at its one end with the support plate 18 by way of a retainer 18*c* (See FIGS. 3 and 5).

The valve parts 36, 38 are respectively fixed on opposite ends of metal plate 34, as shown in FIGS. 3 and 6. The valve part 36 is arranged to normally close a vacuum nozzle 40 which is provided on the bottom wall of casing 11. The vacuum nozzle 40 is hermetically closed by a screw 40*a* at its outer end and is in communication with the extension pipe 43. Meanwhile, the valve part 38 is arranged to normally open a first air nozzle 41 which is provided on the bottom wall of casing 11. The air nozzle 41 is communicated with the atmosphere through an air filter 44.

The solenoid valve 21 comprises a core 23 of magnetic material surrounded by a solenoid winding 25 by way of a bobbin 27, as shown in FIGS. 2, 4 and 5, the bobbin 27 being made of non-magnetic material. The core 23 is secured at its base end to the support plate 18 and provided at its top end or magnetic pole with an annular shock absorber 59. The solenoid valve 21 further comprises a second valve body assembly 29 having an armature 33 of magnetic material, a metal plate 35 of non-magnetic material and a pair of valve parts 37, 39. The armature 33 is fixed on a central portion of metal plate 35, as shown in FIG. 2 and swingably supported at its fulcrum 33*a* on the strut 18*b* of support plate 18 such that the metal plate 35 faces directly to the magnetic pole of core 23. The armature 33 is also biased in a direction apart from the magnetic pole of core 23 by a coil spring 31 which is engaged at its one end with the support plate 18.

The valve parts 37, 39 are respectively fixed on opposite ends of metal plate 35, as shown in FIG. 2. The valve part 39 is arranged to normally open a second air nozzle 42 which is provided on the bottom wall of casing 11. The air nozzle 42 is in communication with the atmosphere through the air filter 44. In addition, the diameter of second air nozzle 42 is larger than that of first air nozzle 41, and the valve part 37 is provided only to balance swinging movement of valve body assembly 29.

The coaxial cable C has three leading wires 46 to 48, as shown in FIG. 1. The leading wire 46 is connected to one terminal of solenoid winding 24 (See FIG. 5), the leading wire 47 is connected to one terminal of solenoid winding 25, and the leading wire 48 is connected as a common leading wire to the other terminals of solenoid windings 24, 25 (See FIG. 4). All the leading wires 46 to 48 are led outwardly through a clamper 50 and a sealing bush 49. The clamper 50 and sealing bush 49 are assembled within a stepped hole 11*a* which is formed in the support structure 17. Furthermore, the leading wires 46, 48 for solenoid winding 24 are connected to the connector 45 to receive the first output signals from the electric control circuit, and the leading wires 47, 48 for solenoid winding 25 are connected to the connector 45 to receive the second output signal from the electric control circuit.

Figure 7:
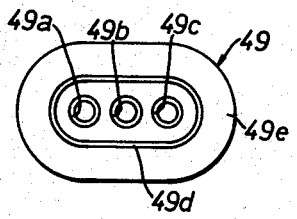
FIG. 7 is an enlarged side view of a sealing bush shown in FIG. 1.
Figure 8:
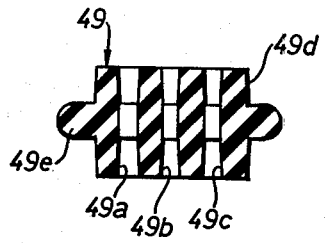
FIG. 8 is a sectional view of the sealing bush of FIG. 7.

As shown in FIGS. 7 and 8, the sealing bush 49 is made of synthetic rubber and has a peripheral wall 49*d* resiliently engaged within the clamper 50 and an annular projection 49*e* engaged within a large diameter portion of the stepped hole 11*a*. The peripheral wall 49*d* of bush 49 is axially tapered toward opposite ends thereof to facilitate the engagement of bush 49 with clamper 50. The bush 49 has three through holes 49*a* to 49*c* through which the leading wires 46 to 48 are inserted into the clamper 50. Each inner wall surface of through holes 49*a* to 49*c* is axially tapered toward the center of bush 49 to facilitate the insertion of leading wires 46 to 48 into the respective holes 49*a* to 49*c*.

Figure 9:
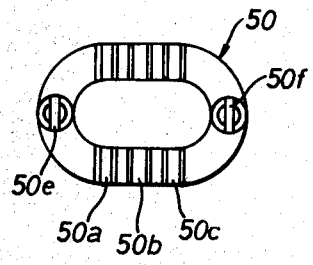
FIG. 9 is an enlarged side view of a clamper shown in FIG. 1.
Figure 10:
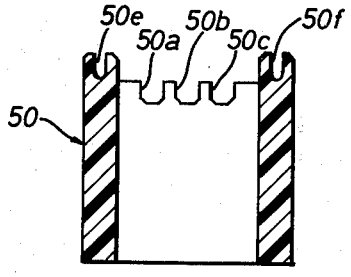
FIG. 10 is a sectional view of the clamper of FIG. 9.

As shown in FIGS. 9 and 10, the clamper 50 is a sleeve of synthetic resin and is provided at one end thereof with three parallel recesses 50*a* to 50*c*. Thus, the leading wires 46 to 48 are respectively received by the recesses 50*a* to 50*c* to be clamped by the support plate 18, as shown in FIG. 5. The clamper 50 is also provided with a pair of projections 50*e*, 50*f* which are fixed to the support plate 18 (See FIGS. 2 and 5). In addition, each depth of recesses 50*a* to 50*c* is smaller than each diameter of leading wires 46 to 48.

Figure 11:
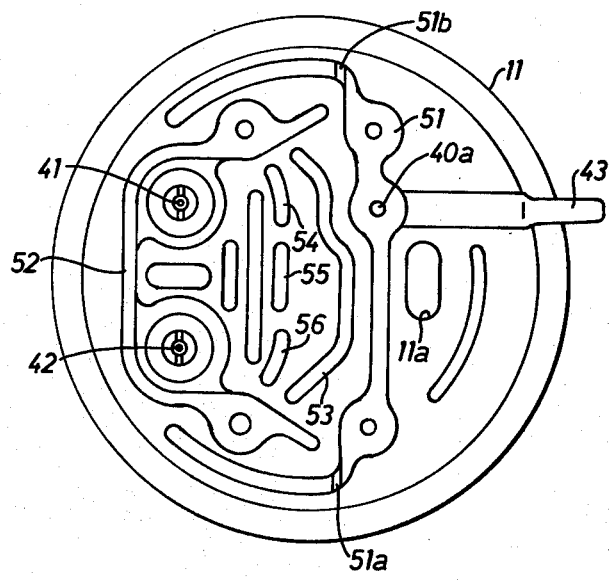
FIG. 11 is a side view of the cup-shaped casing of FIG. 2.

As shown in FIGS. 2, 3 and 11, the casing 11 is integrally formed at its bottom wall with curved projections 51, 52 at which the bracket 57 is secured by the screws 57*a*. The bottom wall of casing 11 is further integrally formed with four curved projections 53 to 56 to support the bracket 57 between the projections and to form a labyrinth between the bracket 57 and the bottom wall. Thus, the air filter 44 is disposed within a space surrounded by the projections 52 to 56 in such a manner that the air flows into the air nozzles 41, 42 through the filter 44 and the labyrinth. The projection 51 is further provided with a pair of slots 51*a*, 51*b*, one of which serves to drop the water entered into the labyrinth so as to protect the filter 44.

In operation, during deenergization of solenoid windings 24, 25, the valve part 36 of first valve body assembly 28 closes the vacuum nozzle 40 due to biasing force of coil spring 30, and the valve part 38 opens the first air nozzle 41 to communicate the pressure chamber 14 with the atmosphere through the air filter 44. In this instance, the valve part 39 of second valve body assembly 29 opens the second air nozzle 42 due to biasing force of coil spring 31 to communicate the chamber 14 with the atmosphere through the air filter 44. This expands the diaphragm 13 due to biasing force of coil spring 19 to close the throttle valve.

When the solenoid windings 24, 25 receive a series of first output signals and a second output signal from the electric control circuit respectively, the solenoid winding 24 is intermittently energized to alternatively attract and release the first body assembly 28 to and from the magnetic pole of core 22, and the solenoid winding 25 is energized to continuously attract the second valve body assembly 29 on the magnetic pole of core 23. Then, the valve parts 36, 38 alternatively open the vacuum and first air nozzles 40, 41 in response to the intermittent attraction of first valve body assembly 28, and the valve part 39 closes the second air nozzle 42 due to the continuous attraction of second valve body assembly 29. Thus, the pressure in the chamber 14 is modulated in response to the first output signals from the electric control circuit such that the diaphragm 13 is displaced against biasing force of coil spring 19 to open the throttle valve. During the above operation, the first and second valve body assemblies 28, 29 are initially engaged with the shock absorbers 58, 59 respectively and subsequently abut against the magnetic poles of cores 22, 23. This eliminates impact on each magnetic pole to prevent unpleasant noises. And also good responsibility of swinging operation of the first valve body assembly 28 may be obtained due to decrease of residual magnetism caused by the metal plate 34.

When the first and second output signals from the electric control circuit cease, the solenoid windings 24, 25 are deenergized to return the first and second valve body assemblies 28, 29 to their original positions. Then, the valve part 36 closes the vacuum nozzle 40, and the valve parts 38, 39 respectively open the air nozzles 41, 42 to communicate the chamber 14 with the atmosphere through the air filter 44. Thus, the atmospheric pressure is rapidly applied into the chamber 14 through both the air nozzles 41, 42 so that the diaphragm 13 is swiftly moved by biasing force of coil spring 19 to close the throttle valve.

Having now fully set forth both structure and operation of a preferred embodiment of the concept underlying the present invention, various other embodiments as well as certain variations and modifications of the embodiment herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. A vacuum servomotor connected to an electric control circuit, conprising:

a one-piece cup-shaped casing with a peripheral wall, said casing having an open end and a bottom wall provided therein with a vacuum nozzle for connection to a source of vacuum and an air nozzle in communication with the atmosphere, said casing being integrally formed at the bottom wall thereof with an open ended cylindrical support structure extending concentrically with and radially spaced from the peripheral wall of said casing, extending inwardly from said bottom wall, and surrounding said air and vacuum nozzles;

a spring-loaded diaphragm assembly hermetically coupled with the open end of said casing to form an expansible chamber within said casing;

a support plate secured to the open end of said cylindrical support structure located within the expansible chamber; and a solenoid valve assembly mounted on said support plate and disposed entirely within the open end of said support structure, said valve assembly including a core of magnetic material secured at one end thereof with said support plate and extending into said support structure, a solenoid winding surrounding said core to be energized by an output signal from said control circuit to provide a magnetic pole at the other end of said core; an armature of magnetic material arranged to be attracted on said magnetic pole by energization of said winding; and a pair of valve parts integral with said armature to normally open and close said air and vacuum nozzles respectively, said valve parts closing and opening said air and vacuum nozzles when said armature is attracted on said magnetic pole in response to energization of said winding.

2. A vacuum servomotor as claimed in claim 1, wherein said spring-loaded diaphragm assembly comprises an expansible diaphragm hermetically coupled with the open end of said casing to form an expansible chamber within said casing, and a coil spring disposed within said chamber and engaged at opposite ends thereof with said diaphragm and the open end of said cylindrical support structure.

3. A vacuum servomotor as claimed in claim 1, wherein said bottom wall of said casing is further provided thereon with an additional air nozzle surrounded by said support structure and in open communication with the atmosphere, and further comprising a solenoid valve assembly mounted on said support plate in parallel with said first-named solenoid valve assembly, said second-named solenoid valve assembly including a core of magnetic material secured at one end thereof with said support plate in parallel with said first-named core, a solenoid winding surrounding said second-named core to be energized by the output signal from said control circuit to provide a magnetic pole at the other end of said second-named core; an armature of magnetic material arranged to be attracted on said second-named magnetic pole by energization of said second-named winding; and a valve part integral with said second-named armature to normally open said additional air nozzle, whereby when said first- and second-named windings are energized by the output signal from said control circuit, said first-named valve parts close and open said air and vacuum nozzles, and said second-named valve part closes said additional air nozzle.

4. A vacuum servomotor as claimed in claim 1, wherein a stepped through hole is formed through a portion of said support structure; and further comprising a bush of elastic material hermetically engaged within a small diameter portion of said stepped hole and being provided with a pair of through holes therethrough; a sleeve member of elastic material engaged within a large diameter portion of said stepped hole and coupled at one end thereof with said bush, said sleeve being engaged at the other end thereof with said support plate and provided at the other end thereof with a pair of recesses; and a pair of leading wires passing through the through holes of said bush and the recesses of said sleeve, said leading wires being connected at one end thereof with said electric control circuit and at the other end thereof with said solenoid winding.

5. A vacuum servomotor as claimed in claim 1, wherein said bottom wall of said casing is integrally provided at the outside face thereof with a plurality of projections forming a space around said air nozzle, and further comprising a bracket secured to a portion of said projections to close said space and to form a labyrinth between the outside face of said bottom wall and said bracket, and an air filter disposed within said space to permit the flow of air from said labyrinth into said air nozzle therethrough.

6. A vacuum servomotor as claimed in claim 3, wherein said additional air nozzle has a larger opening therethrough than the first named air nozzle.

7. A vacuum servomotor as claimed in claim 3, wherein the armatures each comprise a body of magnetic material, the armatures having a valve part at each end thereof and being pivotally mounted between their ends for pivoted movement when the solenoids are energized, the valve parts at the ends of the armature in the first-named valve assembly serving to control flow through the first-named air and vacuum nozzles, and the valve part at an end of the armature of the second-named valve assembly serving to control flow through the additional air nozzle, while the valve part at the other end of the armature of the second-named valve assembly serves merely to balance movement of the valve assembly.

8. A vacuum servomotor as claimed in claim 7, wherein the armatures include an elongate non-magnetic metal plate fixed to the body of magnetic material and having opposite end portions prejecting beyond the ends of the body of magnetic material, the valve parts being carried on the projecting end portions.

* * * * *